US010730652B2

(12) United States Patent
Lazor et al.

(10) Patent No.: US 10,730,652 B2
(45) Date of Patent: Aug. 4, 2020

(54) PACKAGING MACHINE AND METHOD FOR FABRICATING SHEET METAL HOUSING COMPONENTS

(71) Applicant: HEAT SEAL LLC, Cleveland, OH (US)

(72) Inventors: Sean Paul Lazor, Stow, OH (US); Michael Jeffrey Abbott, Strongsville, OH (US)

(73) Assignee: HEAT SEAL LLC, Cuyahoga Heights, OH (US)

( * ) Notice: Subject to any disclaimer, the term of this patent is extended or adjusted under 35 U.S.C. 154(b) by 372 days.

(21) Appl. No.: 15/522,587

(22) PCT Filed: Oct. 28, 2015

(86) PCT No.: PCT/US2015/057868
§ 371 (c)(1),
(2) Date: Apr. 27, 2017

(87) PCT Pub. No.: WO2016/069777
PCT Pub. Date: May 6, 2016

(65) Prior Publication Data

US 2017/0349312 A1 Dec. 7, 2017

Related U.S. Application Data

(60) Provisional application No. 62/069,556, filed on Oct. 28, 2014, provisional application No. 62/072,764, filed on Oct. 30, 2014.

(51) Int. Cl.
*B65B 53/06* (2006.01)
*B65B 41/12* (2006.01)
(Continued)

(52) U.S. Cl.
CPC ..... *B65B 53/063* (2013.01); *B65B 9/093* (2013.01); *B65B 41/12* (2013.01); *B65B 59/00* (2013.01); *B65B 67/10* (2013.01); *B65B 59/02* (2013.01)

(58) Field of Classification Search
CPC .. B65B 9/06; B65B 9/073; B65B 9/08; B65B 9/093; B65B 11/50; B65B 11/52;
(Continued)

(56) References Cited

U.S. PATENT DOCUMENTS 3,629,990 A * 12/1971 Calvert ..... B29C 49/38 53/553
4,162,604 A * 7/1979 Bartolomei ..... B65B 53/06 219/243
(Continued)

OTHER PUBLICATIONS

PCT/US2015/057868 International Search Report & Written Opinion, completed Feb. 2, 2016.

*Primary Examiner* — Hemant Desai
*Assistant Examiner* — Veronica Martin
(74) *Attorney, Agent, or Firm* — Tarolli, Sundheim, Covell & Tummino LLP

(57) ABSTRACT

A heat sealing packaging machine and method for assembling that includes a package platform for supporting a package, a film carriage carrying a supply of film material, a sealing platform adjacent the package platform and including a conveyor for laterally moving the package to be sealed to a shrink tunnel. The carriage is laterally movable to adjust the position of the film material and a lifting mechanism raises and lowers the sealing platform and the shrink tunnel. The shrink tunnel is laterally movable with respect to the sealing platform and includes a latch mechanism for locking a lateral position of the shrink tunnel.

15 Claims, 19 Drawing Sheets

(51) Int. Cl.

| | |
|---|---|
| ***B65B 67/10*** | (2006.01) |
| ***B65B 9/093*** | (2012.01) |
| ***B65B 59/00*** | (2006.01) |
| ***B65B 59/02*** | (2006.01) |

(58) Field of Classification Search
CPC ..... B65B 41/12; B65B 41/18; B65B 53/063; B65B 59/02
USPC ..... 53/51, 556, 557, 373.7, 373.9, 374.8, 53/374.9
See application file for complete search history.

(56) References Cited

U.S. PATENT DOCUMENTS

| | | | | |
|---|---|---|---|---|
| 4,724,652 | A * | 2/1988 | Birkenfeld | B65B 53/02 53/170 |
| 6,701,696 | B1 * | 3/2004 | Torre | B65B 51/148 53/442 |
| 2003/0044744 | A1 * | 3/2003 | Nava | B65B 53/063 432/121 |
| 2008/0148691 | A1 * | 6/2008 | Elsperger | B65B 53/066 53/442 |
| 2012/0096809 | A1 * | 4/2012 | Grimm | B65B 9/04 53/396 |
| 2014/0020344 | A1 | 1/2014 | Liao | |
| 2014/0272747 | A1 * | 9/2014 | Ciurkot | F27D 3/12 432/239 |
| 2016/0176598 | A1 * | 6/2016 | Palumbo | B65D 81/2038 206/497 |

* cited by examiner

FIG.11
ASSEMBLY
STEP 1
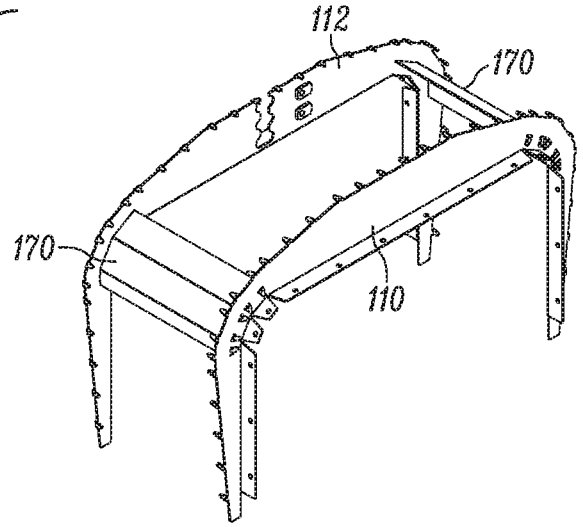
FIG. 11A
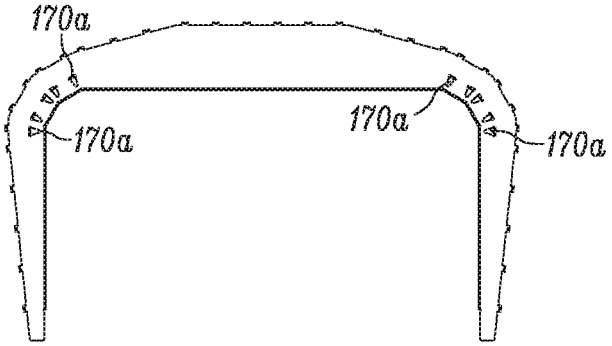
FIG. 11B
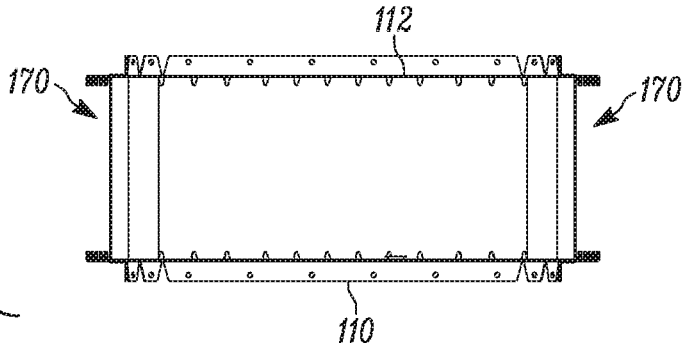
FIG. 11C

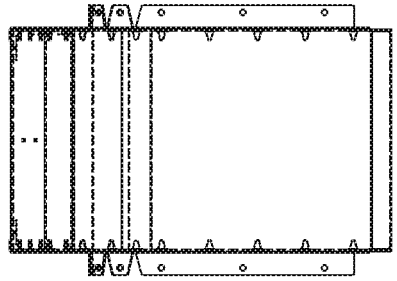
FIG. 12E
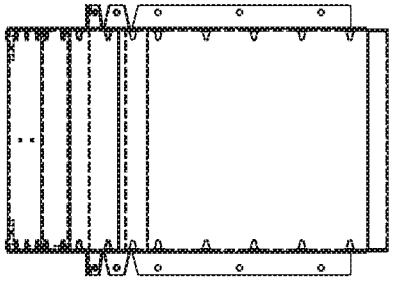
FIG. 12F
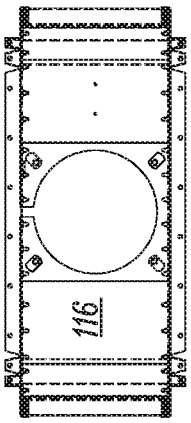
FIG. 12C
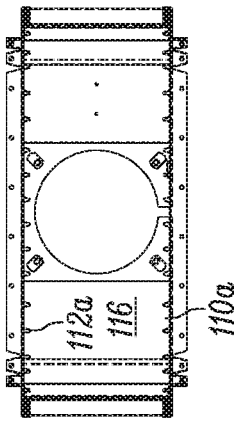
FIG. 12D
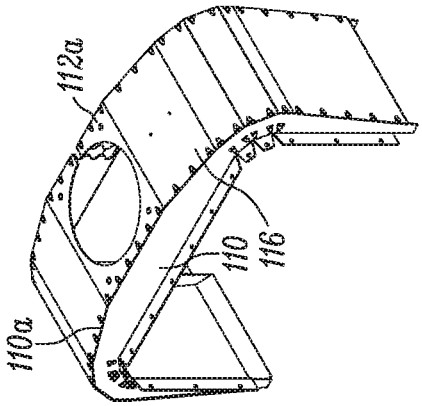
FIG. 12A
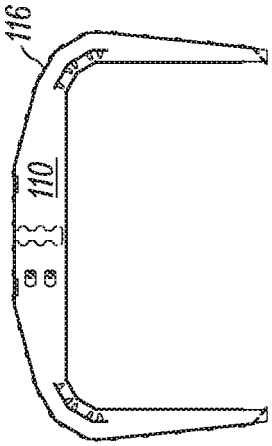
FIG. 12B
FIG.12
ASSEMBLY
STEP 2

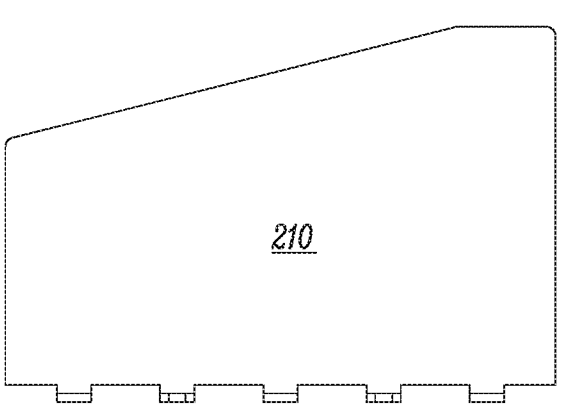
FIG. 13B
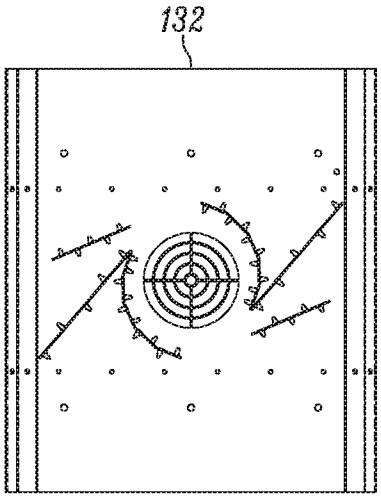
FIG. 13D
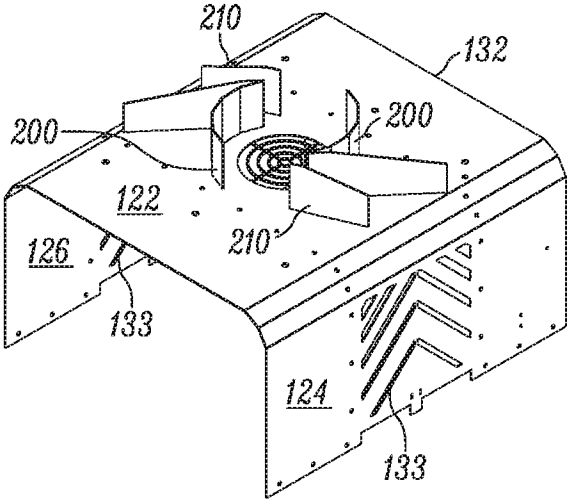
FIG. 13A
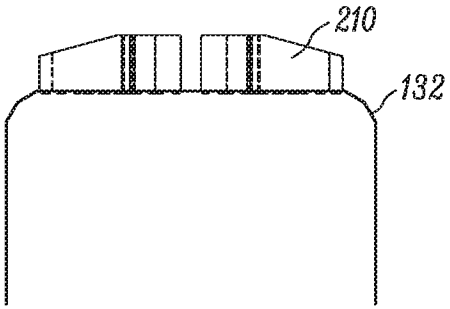
FIG. 13C
FIG.13
ASSEMBLY
STEP 3

ASSEMBLY
STEP 4

PACKAGING MACHINE AND METHOD FOR FABRICATING SHEET METAL HOUSING COMPONENTS

CROSS REFERENCES TO RELATED APPLICATIONS

This application filed under 35 U.S.C. § 371 is a national phase application of International Application Serial Number PCT/US2015/057868 filed Oct. 28, 2015, which claims priority to U.S. Provisional Application Ser. No. 62/069,556, filed Oct. 28, 2014 and U.S. Provisional Application Ser. No. 62/072,764, filed on Oct. 30, 2014.

RELATED APPLICATIONS

This application claims priority from U.S. Provisional Application No. 62/069,556, filed Oct. 28, 2014 and U.S. Provisional Application No. 62/072,764, filed Oct. 30, 2014, the entirety of which are incorporated herein by reference.

TECHNICAL FIELD

The present invention relates generally to an improved package sealing machine, and a method for making and shaping sheet metal panels and housing components.

BACKGROUND ART

Packaging machines which enclose packages in shrink wrap film are in common use today. In most instances, these types of machines are low volume products and are hand assembled because they are not manufactured in sufficient numbers to justify automated and expensive tooling. In order to be successful, these packaging machines must accommodate a wide variety of package sizes which require various widths of packaging film. Most, if not all, of these machines require a heating unit for shrinking the film to provide a tight abutting contact between the film and the package. In general, this type of packaging machine includes a platform for initially wrapping the package, a package sealing station where the edges of the film are cut and sealed and a heating station which shrinks the film around the package. Because the machine must accommodate a wide variety and size of the packages, these three stations must be relatively movable with respect to each other so that a package being processed will travel along a path that will be at or near a center line of the heating tunnel so that uniform heating and shrinking of the film around the package will be achieved.

DISCLOSURE OF INVENTION

The present invention provides a new and improved method and apparatus for heat sealing packages with plastic film. A method for fabricating a duct assembly is also disclosed, which allows an assembly person to form duct and other housing components using hand tools and does not require expensive tooling or stamping dies. The disclosed packaging machine includes a package platform for supporting a package to be wrapped and sealed in a plastic film. A film carriage carries a supply of film material and also includes a tension mechanism for applying forces to the web and to a support roll for resisting uncontrolled rotation of the film supply roll. A sealing platform adjacent the package platform includes a conveyor for laterally moving a package from the sealing platform to a heated shrink tunnel. The film supply carriage is laterally movable to adjust the position of a folded web of material and includes a latch mechanism engageable with one or more of a plurality of slots forming part of the film carriage, whereby the film carriage is locked in a position relative to the package platform. A zero gravity, scissors-type lift is used to raise and lower the sealing platform and the heated shrink tunnel. The shrink tunnel is also laterally movable with respect the sealing platform and includes a positioning mechanism that includes a toothed track that is engageable by a handle operated latch mechanism which locks the lateral position of the heated shrink tunnel with respect the sealing platform. The sealing platform includes an L-bar sealer which seals the edges of a folded web in which the package is placed and also severs the sealed package from the film supply . After the edges are sealed and the film segment in which the package is contained is severed, the package enclosed by the plastic film is conveyed through a heated shrink tunnel, whereby the plastic film shrinks into tight abutting contact with the package.

In the disclosed apparatus, the heated shrink tunnel includes a heated duct assembly that is constructed using a methodology according to the invention. The duct assembly includes at least one panel having a plurality of lines of weakness for facilitating the bending of the panel into a predetermined configuration/contour by an assembly person using hand tools. The lines of weakness comprise at least one transverse slot intermediate bridging segments, the slot defining location of the bend and in the slot configured such that, upon bending along the line of weakness, opposite edges of the slot co-engage to inhibit the passage of heated air through the slot. The disclose duct assembly also includes components that have flanges that are also bent along lines of weakness and which are adapted to attach to other duct components using fasteners such as rivets. Certain components of the duct assembly also include a plurality of slots that are adapted to receive tabs formed on other plate components with the tabs being bendable by an assembly person after passing through the slots in order to securely attach the panel to the plate members.

The disclosed methodology can be used to fabricate sheet metal components and housings for a variety of applications. The use of slots intermediate bridging segments for defining bend locations in a panel allow an assembly person to easily shape components into their final configuration, and the use of tabs and slots allows the components to be secured together again using ordinary hand tools. This methodology is especially useful for fabricating and joining components made from flat roll ductile stock and because it does not require expensive tooling or stamping dies, can be used to make relatively low volume products that cannot justify the expense of costly tooling.

The disclosed heat sealing packaging machine also includes a cooling feature which inhibits heat generated by the shrink tunnel from being transmitted to exterior surfaces of the machine. In the disclosed construction, cooling air is circulated around the shrink tunnel and, in particular, flows between an outside surface of the shrink tunnel and inside surfaces of external panels of the packaging machine. A cooling fan draws in cooling air from outside and forces it around the shrink tunnel. Cooling air is ultimately discharged through a discharge port formed in one of the external packaging machine panels.

Additional features of the invention will become apparent and a fuller understanding obtained by reading the following detailed description made in connection with the accompanying drawings.

BRIEF DESCRIPTION OF DRAWINGS

FIG. 11 illustrates the method by which one part of the heating duct assembly is formed;

FIG. 12 illustrates another step showing how other portions of the heating duct assembly are formed;

FIG. 13 illustrates the steps by which another portion of the heating duct assembly is formed;

DETAILED DESCRIPTION

Figure 1A:
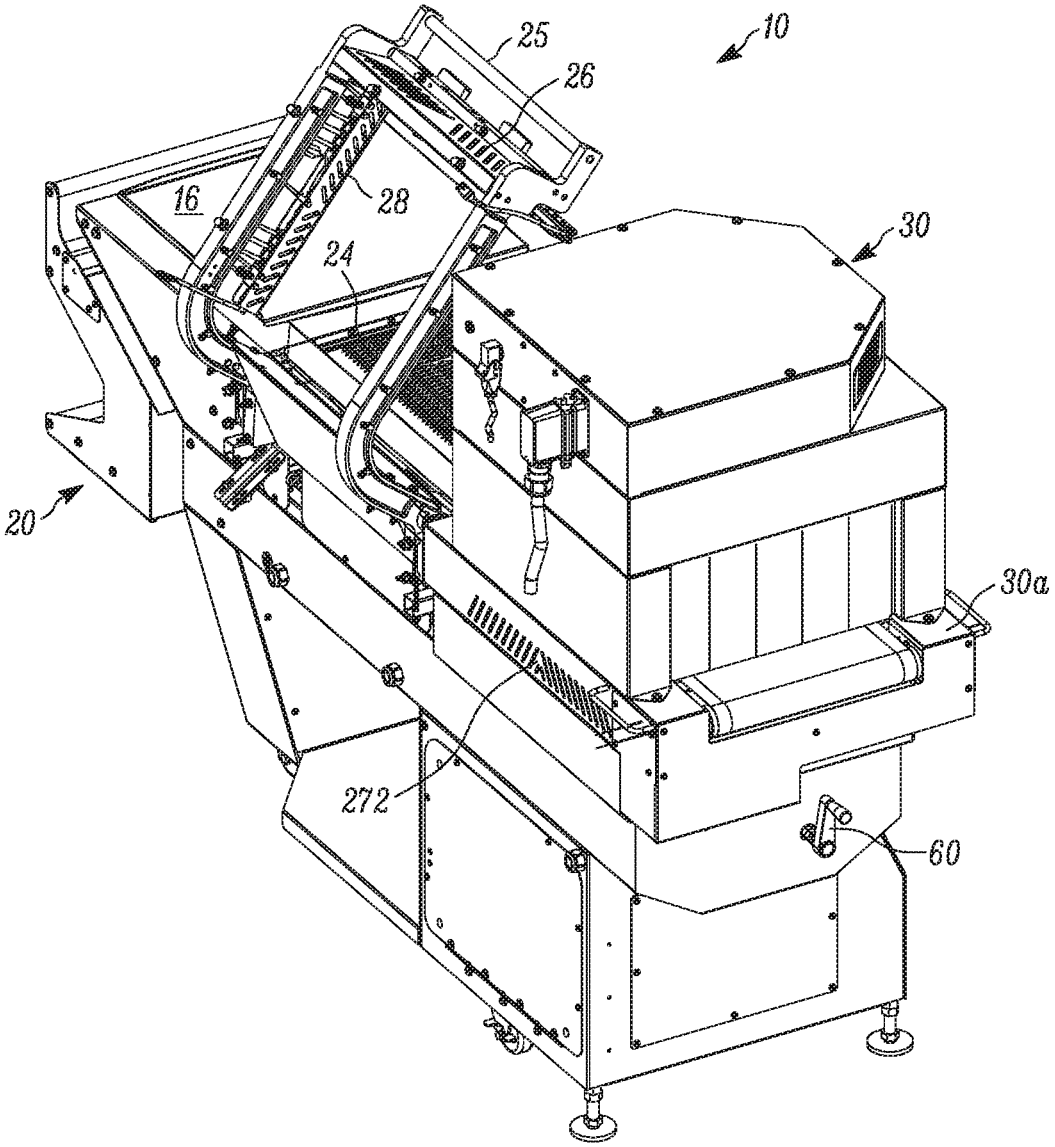
FIGS. 1A-1B illustrate front and rear isometric views of a packaging machine constructed in accordance with a preferred embodiment of invention.
Figure 1B:
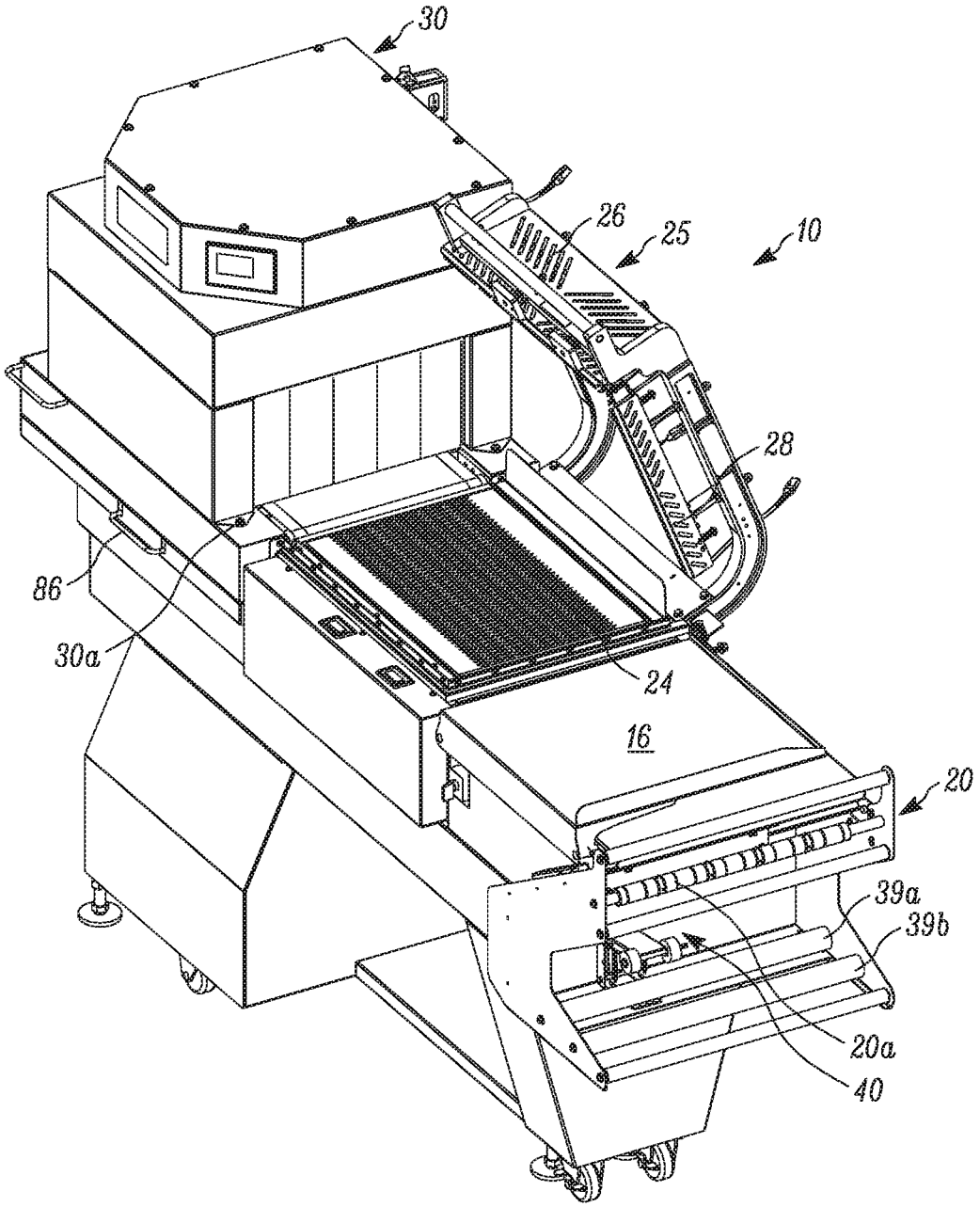

FIG. 1 illustrates front and rear isometric views of a package sealing machine 10 constructed in accordance with a preferred embodiment of the invention. The illustrated machine 10 is a substantial improvement or enhancement of a prior art sealing machine which is illustrated and described in Appendix 1 and which is hereby incorporated by reference. The illustrated machine includes a package platform 16 at which a package is initially placed between the layers of a folded plastic web in a known way. The plastic web, which ultimately is used to seal the package, is fed from a film cradle or carriage indicated generally by the reference character 20. The sealing film is unwound from a supply roll which is supported by the film cradle. A perforating roller 20*a* may also form part of the film feed carriage which operates to place small punctures in the film to allow air to escape during a shrinking process.

The package that is placed between the folds of the sealing film is then moved to a sealing station which includes a sealing platform/conveyor 24. When the package within the folds of the sealing film is in a proper sealing position, a sealing frame 25 that carries an L-bar sealer apparatus, is pivoted downwardly to a closed position at which a transverse seal is formed on the web by a heated transverse sealing bar/cutter 28 and a longitudinal seal is formed by a longitudinal heat sealing bar 26. The transverse sealing bar 28 not only creates a region where the upper and lower folds of the web are sealed together, but also severs the web and sealing/joining the trail end of the web segment in which the package is located, as well as sealing/joining the leading edge of the web.

The heat sealing frame 25 is then raised and the package with the sealed edges is moved by the sealing platform conveyor 24 onto a shrink tunnel conveyor 30*a* which moves the package through a heat tunnel 30 which shrinks the sealing film into tight abutting contact with the package.

According to the invention, the film cradle 20 is laterally movable so that the position of the folded web on the package platform 16 can be adjusted to improve transport of the package from the platform 16 to the shrink tunnel 30. The shrink tunnel 30 is also laterally movable so that its position can be adjusted such that the package leaving the sealing platform 24 passes generally through the center of the shrink tunnel 30. As will be explained, the lateral positions of the film carriage 20 and heat tunnel 30 are selectively adjustable by associated indexing mechanisms. The height of the shrink tunnel conveyor is also adjustable by a scissors-type elevator to be described.

Figure 2A:
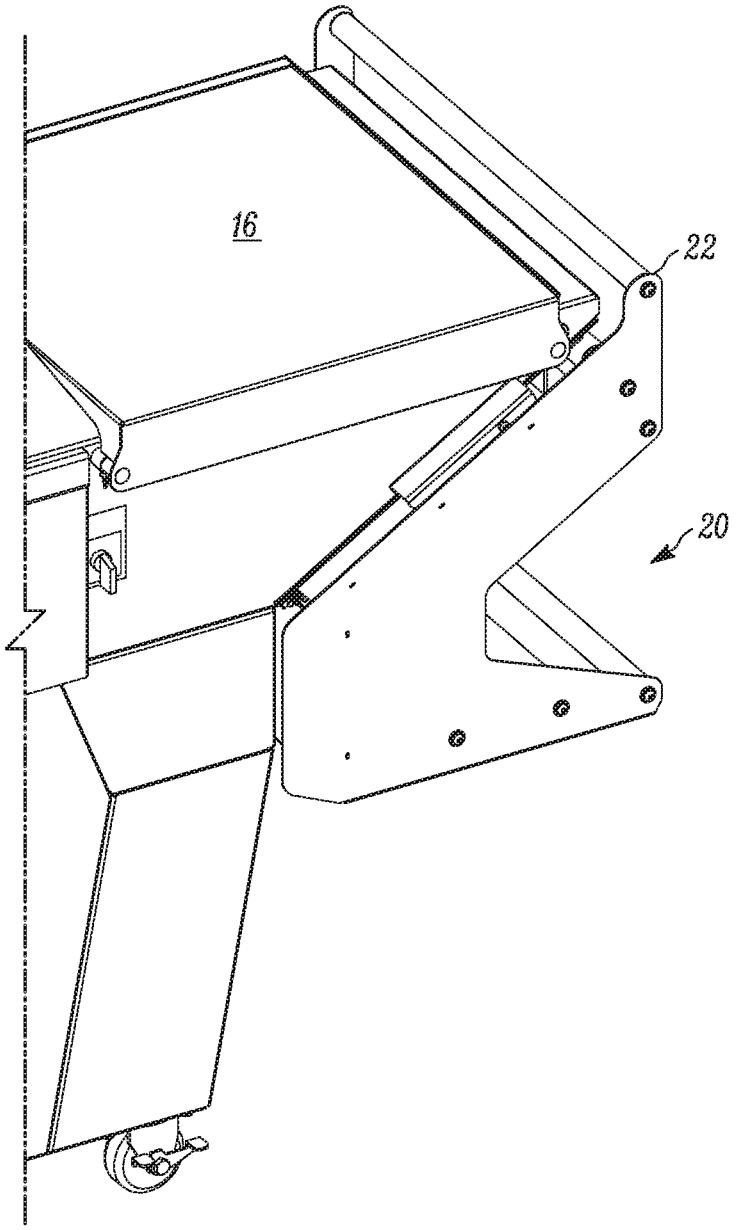
FIGS. 2A, FIG. 2B, FIG. 2C and FIG. 2D are fragmentary views of the packaging machine shown in FIG. 1A, showing details of a film carriage adjustment mechanism.
Figure 2C:
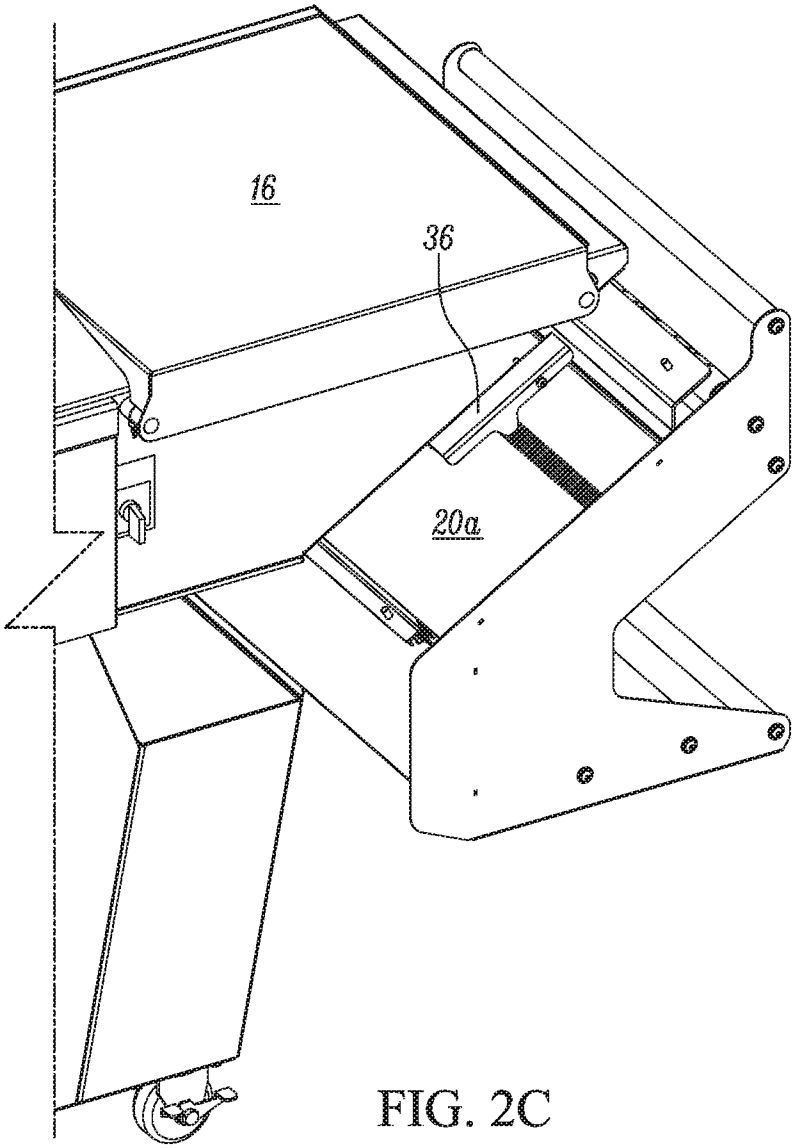
Figure 2B:
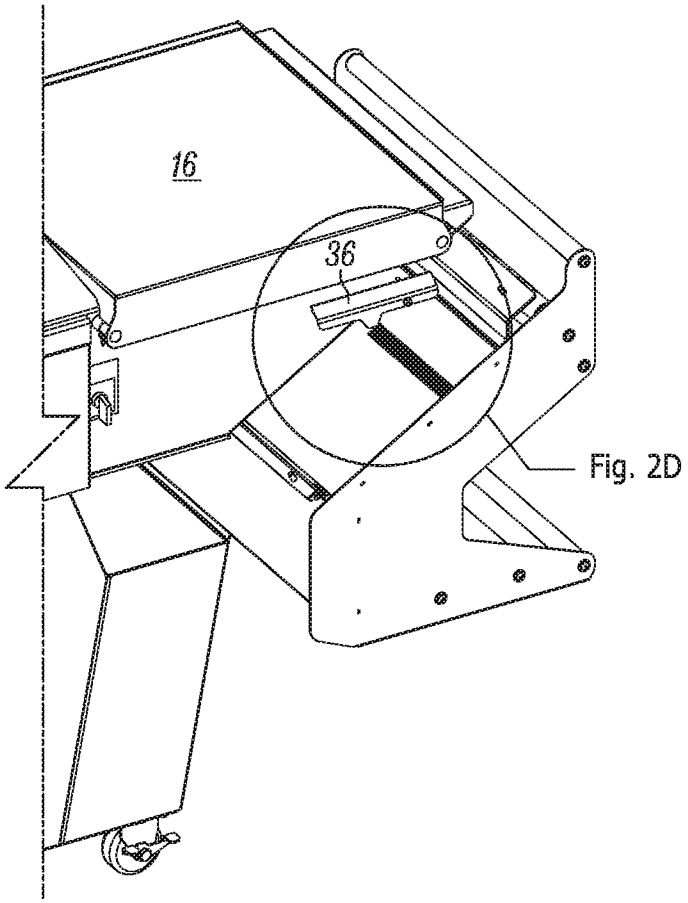
Figure 2D:
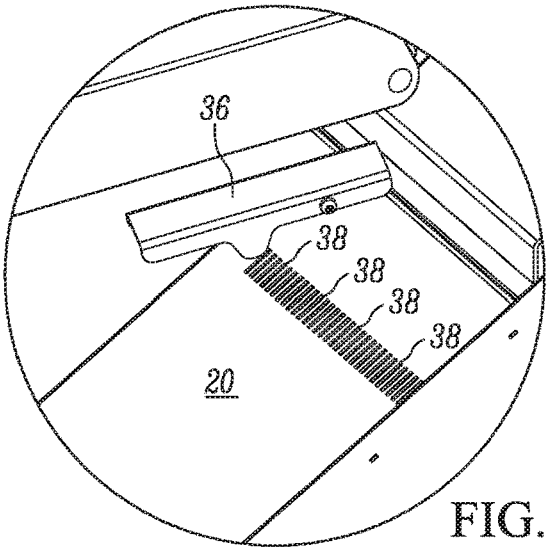

Referring to FIGS. 2A-2D, the movement and adjustment of the film carriage 20 is illustrated. As seen best in FIG. 2A, the film carriage 20 is shown in a centered position. FIG. 2B shows the carriage moved laterally toward the operating side of the sealing machine. A pivoting locking member 36 is used to lock the position of the carriage 20. As seen best in FIGS. 2C and 2D, the pivoting locking lever 36 is engageable with a panel 20*a* that forms part of the carriage assembly 20. The panel 20*a* includes a plurality of slots 38 which are exposed when the carriage is moved laterally. The position of the carriage is secured by allowing the pivoting lock member 36 to enter an appropriate slot 38 formed in the carriage panel 20*a* whereby lateral movement with respect to the package platform 16 is inhibited.

Figure 2E:
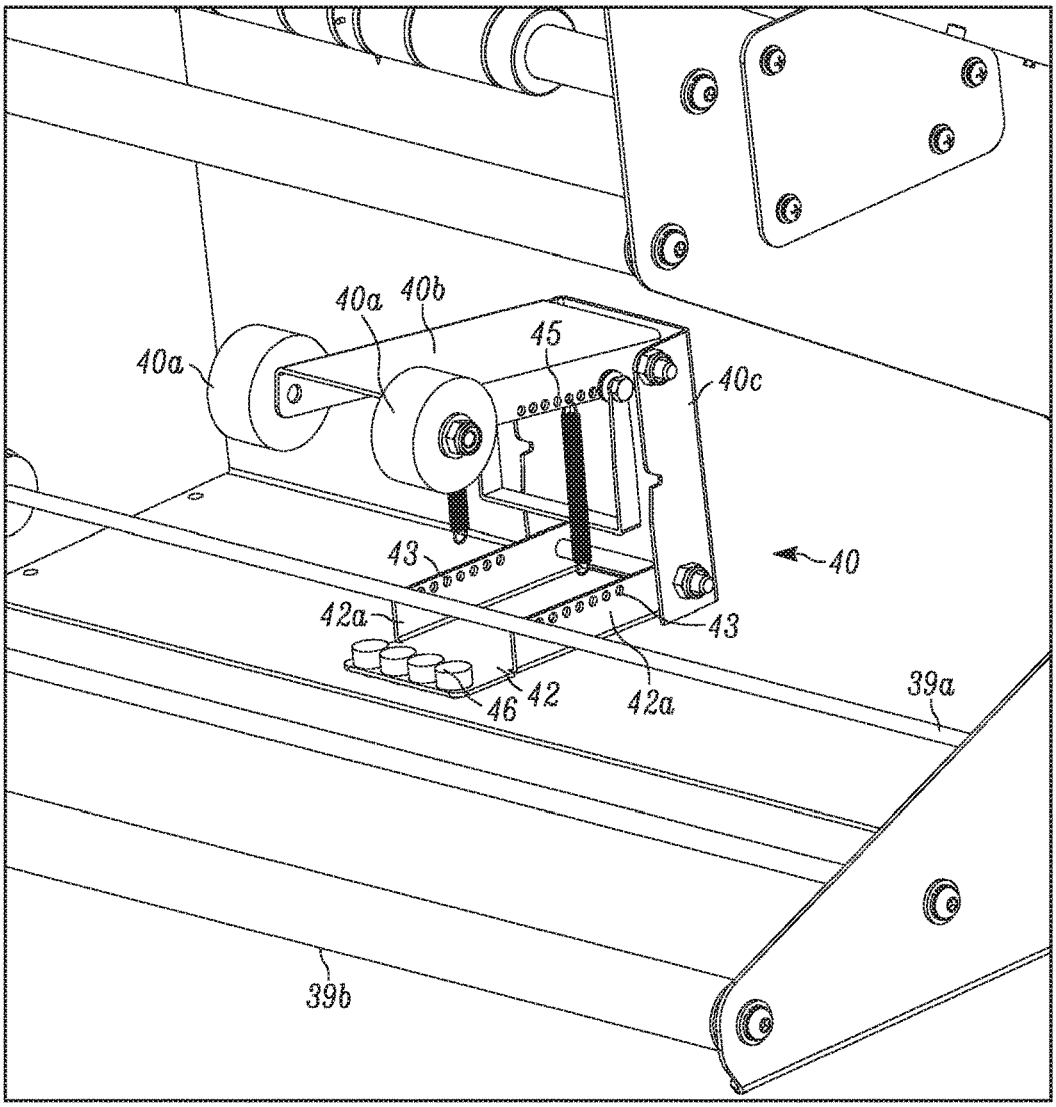
FIG. 2E illustrates another rear isometric view of the packaging machine showing a film supply tension mechanism which is shown in more detail in FIG. 2F.

FIG. 2E illustrates a pivoting tension mechanism 40 (see also FIG. 1B) for holding a film supply roll properly positioned in the carriage 20 and to exert a drag on the web discharged by a film supply roll. A film supply roll (not shown) is supported in the carriage 20 by a pair of support rolls 39*a*, 39*b* (the roller 39*a* is shown best in FIG. 1B). As seen in FIG. 2E, the tension mechanism 40 includes a pair of rollers 40*a* attached to a bracket 40*b*. The bracket 40*b* is pivotally attached to a mounting bracket 40*c*. A drag plate 42 is also pivotally attached to the mounting bracket 4*c* and includes a pair of flanges 42*a* that each include a plurality of holes 43. The drag plate 42 also mounts a plurality of snubbers 45 that frictionally engage the roll 39*a* that partially supports the film supply roll. The bracket 40*b* to which the tension rollers 40*a* are mounted includes associated holes 45. The holes 45 and holes 43 are adapted to receive one more tension springs which urge the roller bracket 40*b* to pivot towards a film supply roll (not shown) that is positioned in the carriage 20 and urge the snubbers 46 on the base plate 42 into frictional contact with the film supply support roll 39 and apply a force tending to resist rotation. The force applied by the tension rollers 40*a* operate to maintain the position of the film supply roll in the carriage 20 (i.e., on the support rolls 39*a*, 39*b*) when film is pulled by the operator The tension rollers 40*a* allow the supply roll to rotate and to allow film to be pulled by the operator while maintaining the position of the supply roll in the carriage 20. At the same time, the snubbers 46 which may be rubber or other elastomer apply a frictional force to the roll 39*a* to resist rotation. It also should be noted here that a fresh film supply roll will have a large diameter and, thus, the distance between the snubbers 45 and the tension rollers 40*a* will be the greatest, thus stretching the tension springs extending between the holes 43 and holes 45 to a greater extent. This results in greater frictional forces applied to the support roll 39*b* and to the film web, supply roll by the rollers 40*a*.

Figure 3A:
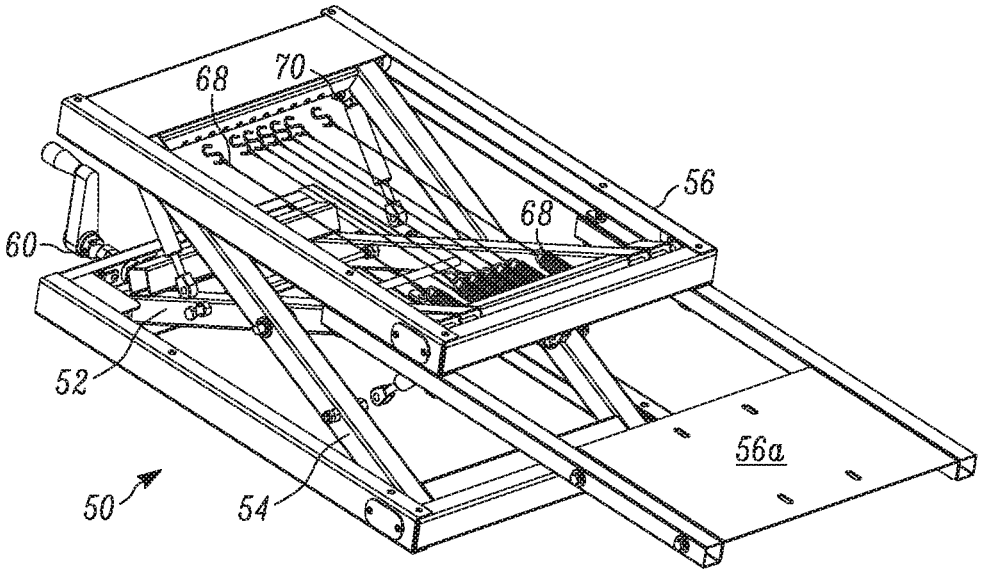
FIGS. 3A and 3B illustrates front and rear isometric views of a zero gravity lift mechanism forming part of the packaging machine shown in FIG. 1.
Figure 3B:
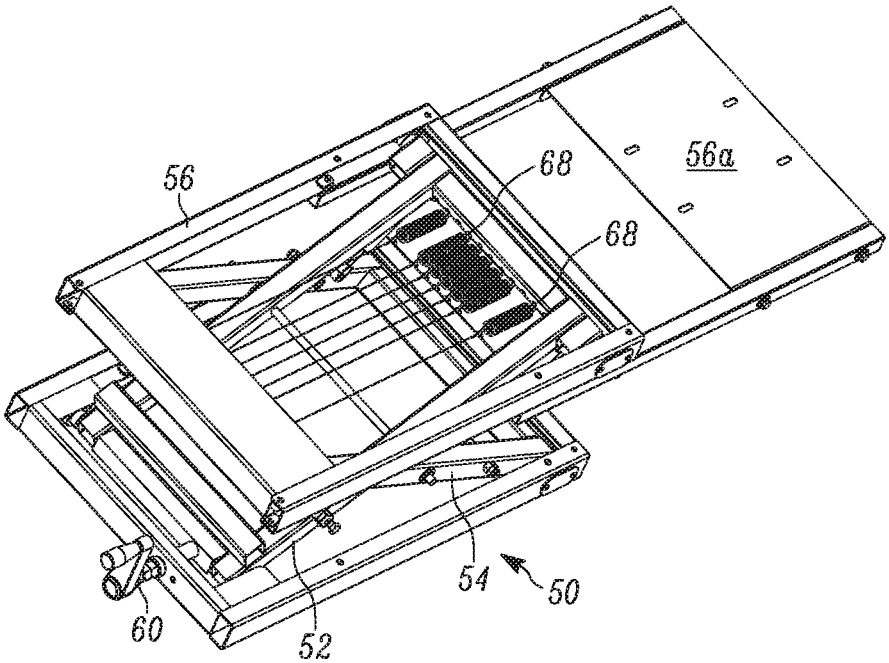
Figure 3C:
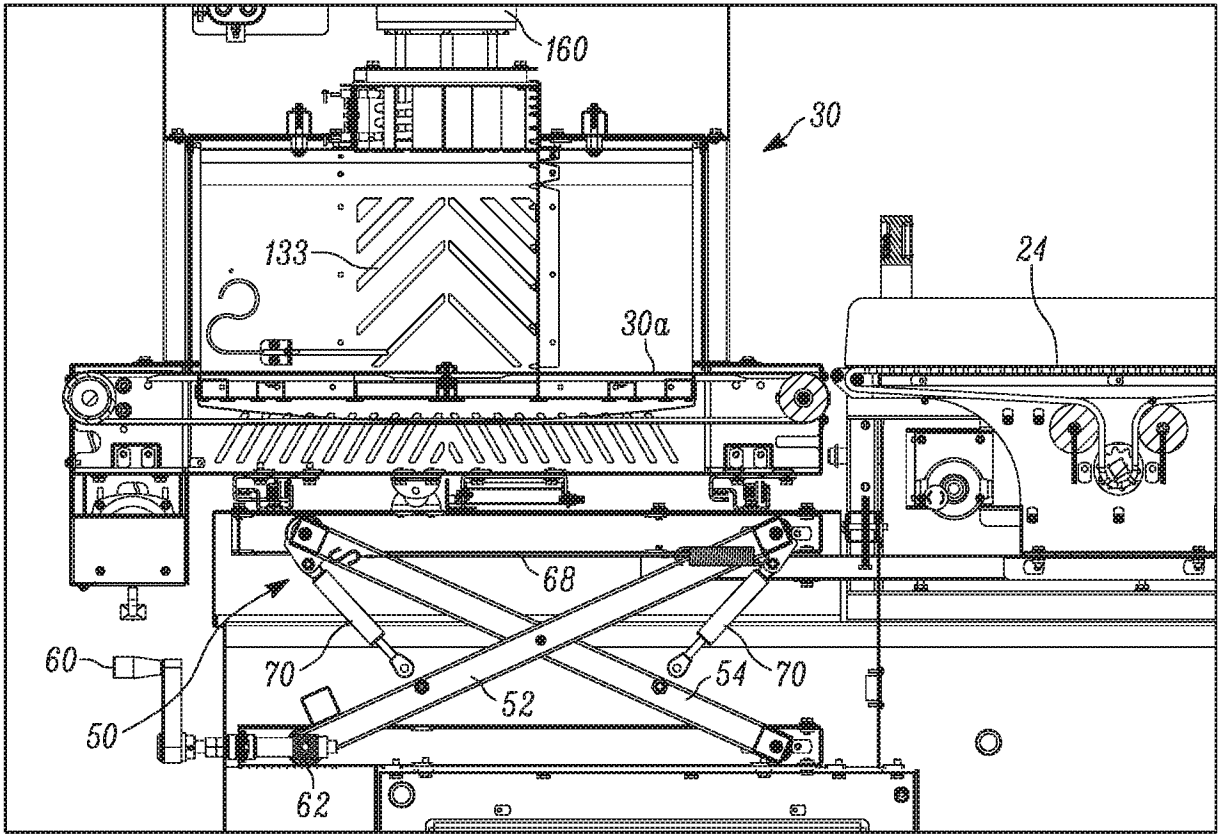
FIG. 3C is a fragmentary sectional view of the packaging machine shown in FIG. 1, showing details of the lift mechanism and a heating tunnel.

Turning to FIGS. 3A and 3B, a scissors mechanism 50 for raising and lowering the shrink tunnel 30 illustrated. As seen in FIGS. 3A and 3B, a pair of scissor members 52, 54 are pivotally connected to each other. Upper ends of the scissor members 52, 54 are connected to a horizontal conveyor support frame 56 and are operatively connected to a crank 60. In particular, the crank 60 threadedly engages a driven member 62 attached to the scissor members 52 such that rotation of the crank 60 moves the driven member 62 laterally, which causes it to move lower ends of the members 52, 54 towards each other in order to raise the platform 56. The lower ends of the members 54 are preferably pivotally connected to the base of the machine and do not translate in the horizontal direction. Alternately, the driven member moves the lower ends of the members 52, 54 apart in order to lower the platform 56. Springs 68 are used to counterbalance the weight of the shrink tunnel 30 so that very little effort is needed to rotate the crank 60 in order to effect lifting and raising of the tunnel 30. Referring also to FIG. 3C, the zero gravity scissors lift may also include gas springs 70 which exert forces on the members 52, 54 tending to raise the platform support frame 56, thus further reducing the effort needed in order to rotate the crank 60 As seen best in FIGS. 3A and 3B, the support frame 56 also includes an extension 56*a* which supports the sealing platform 24 so that both the tunnel 30 and sealing platform 24 are raised and lowered by operation of the crank 60.

Figure 4A:
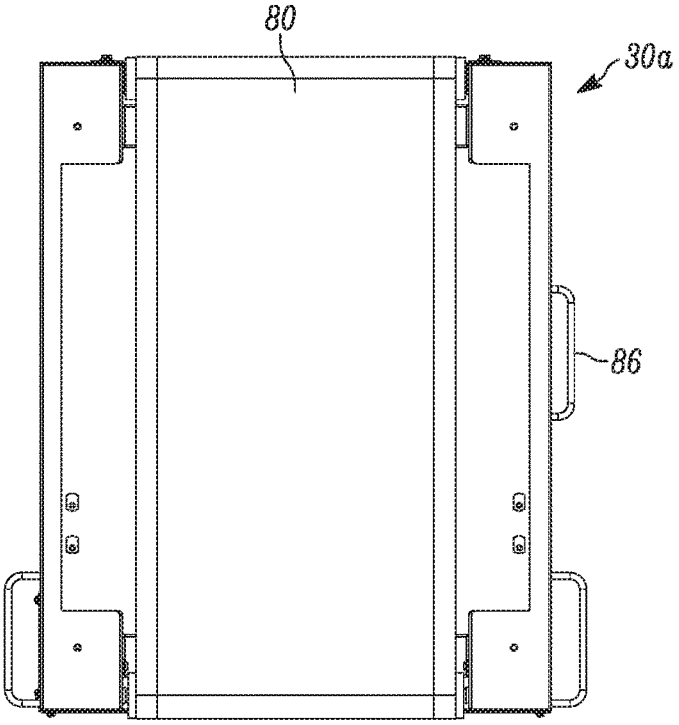
FIG. 4A is a plan view of a package conveyor forming part of a heating tunnel.
Figure 4B:
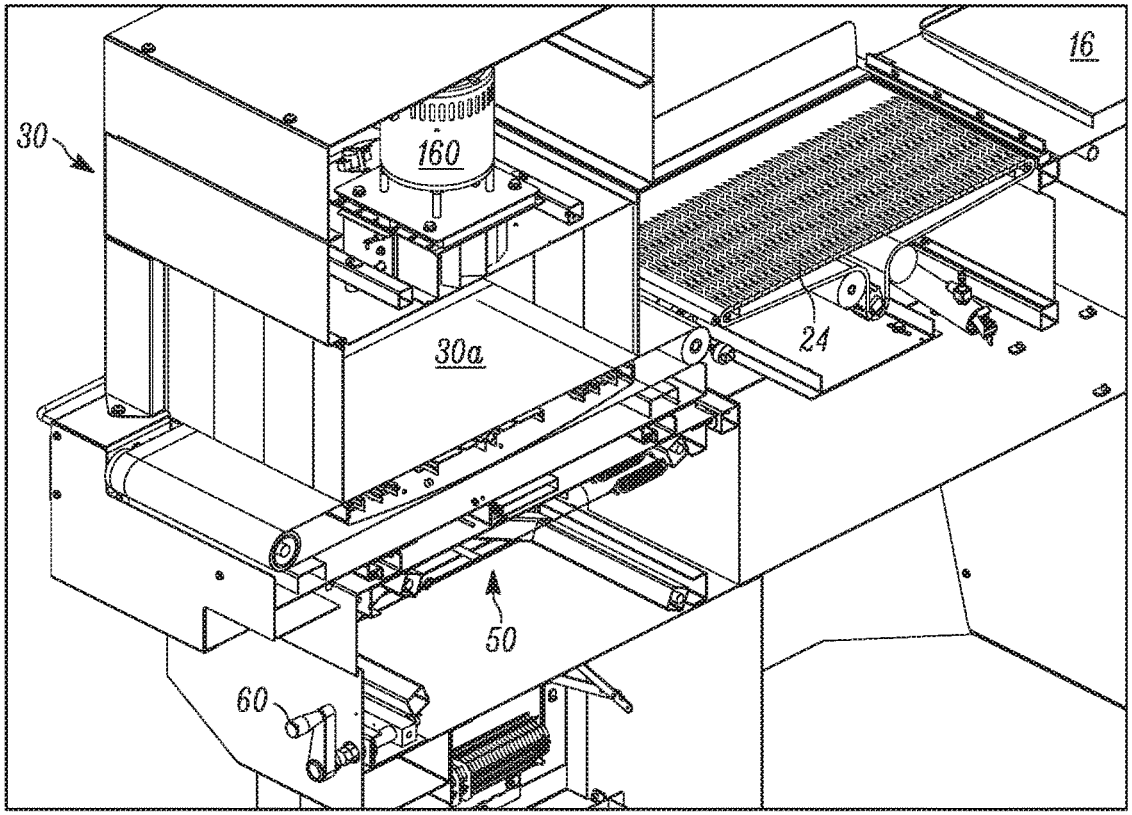
FIG. 4B is another isometric, partially sectional view, showing details of the heating tunnel and the elevator lift mechanism.
Figure 4C:
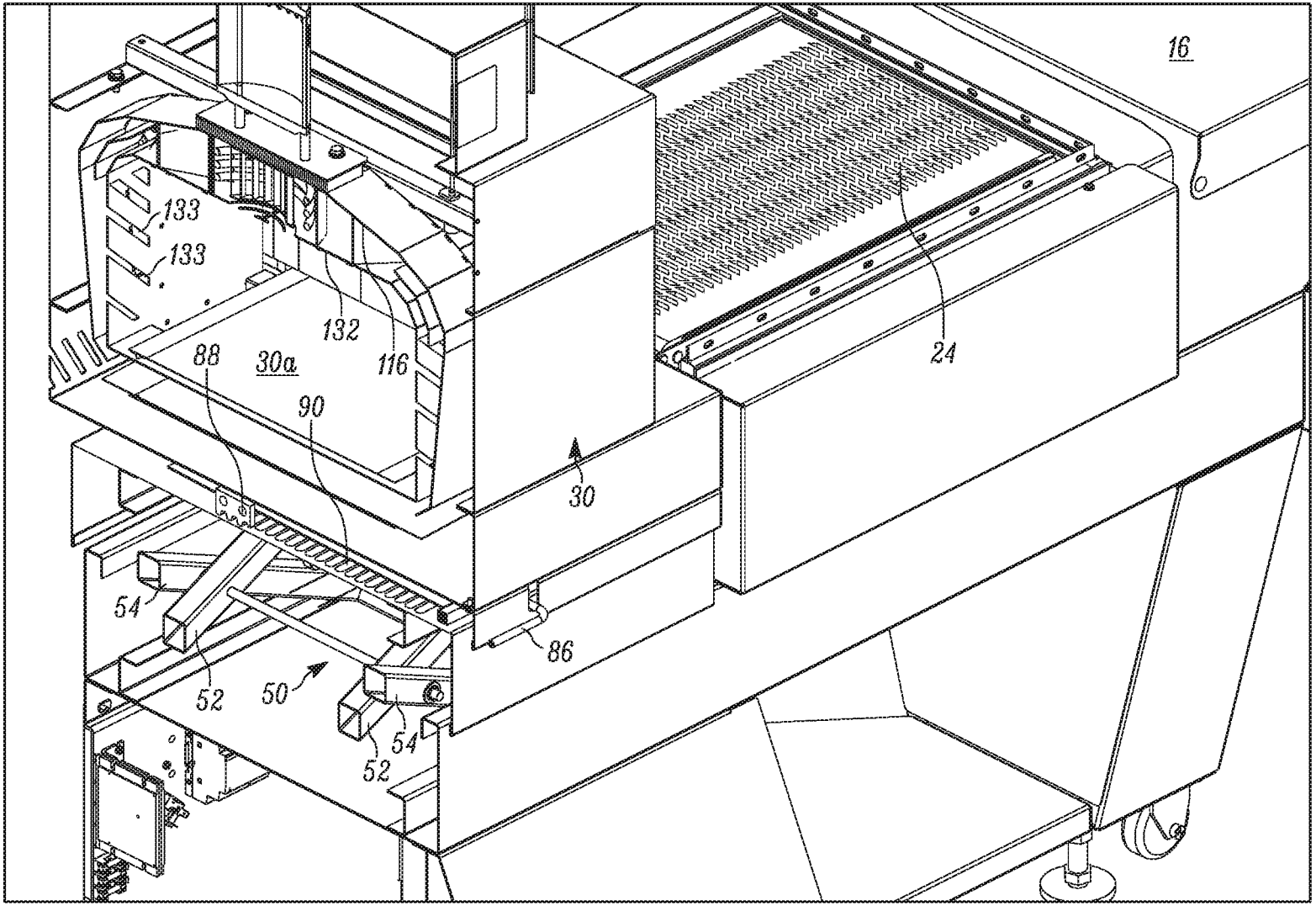
FIG. 4C is an isometric, partly sectional view of the packaging machine showing details of a latching mechanism for controlling the lateral position of the heating tunnel.

FIGS. 4A-4C illustrates the tunnel conveyor 30*a* which is indicated above as laterally movable in order to adjust the position of the conveyor with respect to the package leaving the sealing platform 24. Generally, the package to be sealed leaving the sealing platform should travel along a center line of the conveyor 30*a* so that uniform heating of the package is achieved. The conveyor is motor driven and, in the preferred embodiment, the conveyor comprises a Kevlar belt 80 and allows heated air generated within the tunnel 30 to move through the conveyor 30*a* and around the package in order to shrink the film. A suitable belt is available from Advanced Flexible Composites of Lake in the Hills, Ill. According to a feature of the invention, the profile of the conveyor, as seen best in FIG. 4*c*, includes a crowned upper surface 80*a* which reduces the chances of the package sticking to the belt and promotes more uniform circulation of the heated air around the entire package.

The tunnel conveyor includes a latching mechanism that is operated by a handle 86 located at the front of the carriage assembly. In the preferred embodiment, the handle is raised to raise a latch mechanism and allow the tunnel to move laterally. Once in position, the handle is allowed to lower which locks the conveyor 30 (and tunnel) in the selected position with respect to the sealing platform 24. As seen best in FIG. 4C, the handle 86 is operatively connected to a latch plate 88; raising and lowering the handle 86, raises and lowers the latch plate 88 with respect to a toothed track 90. When the handle 86 is raised, the latch plate 88 disengages the toothed track 90 and this allows the tunnel 30 to move laterally by either pushing or pulling on the handle 86. When the tunnel 30 is in the desired position, the handle 86 is lowered to allow the latch plate 88 to reengage the toothed track 90, thus locking the lateral position of the tunnel 30. FIG. 4B illustrates the overall construction and relationship between the zero gravity lift 50, the sealing platform conveyor 24 and the tunnel conveyor 30*a*.

Figure 5A:
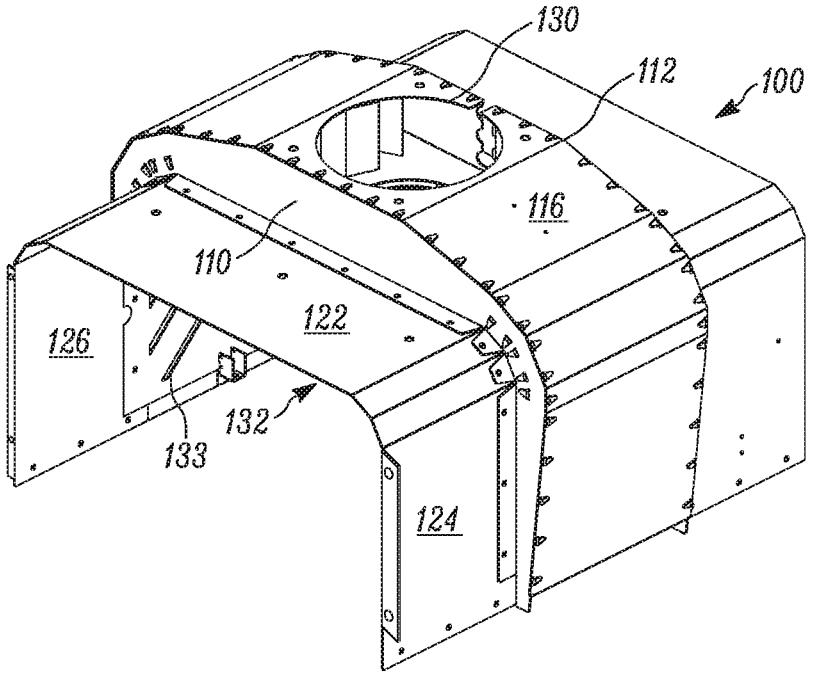
FIGS. 5A and 5B are isometric views of a heating duct assembly constructed in accordance with a preferred embodiment of the invention.
Figure 5B:
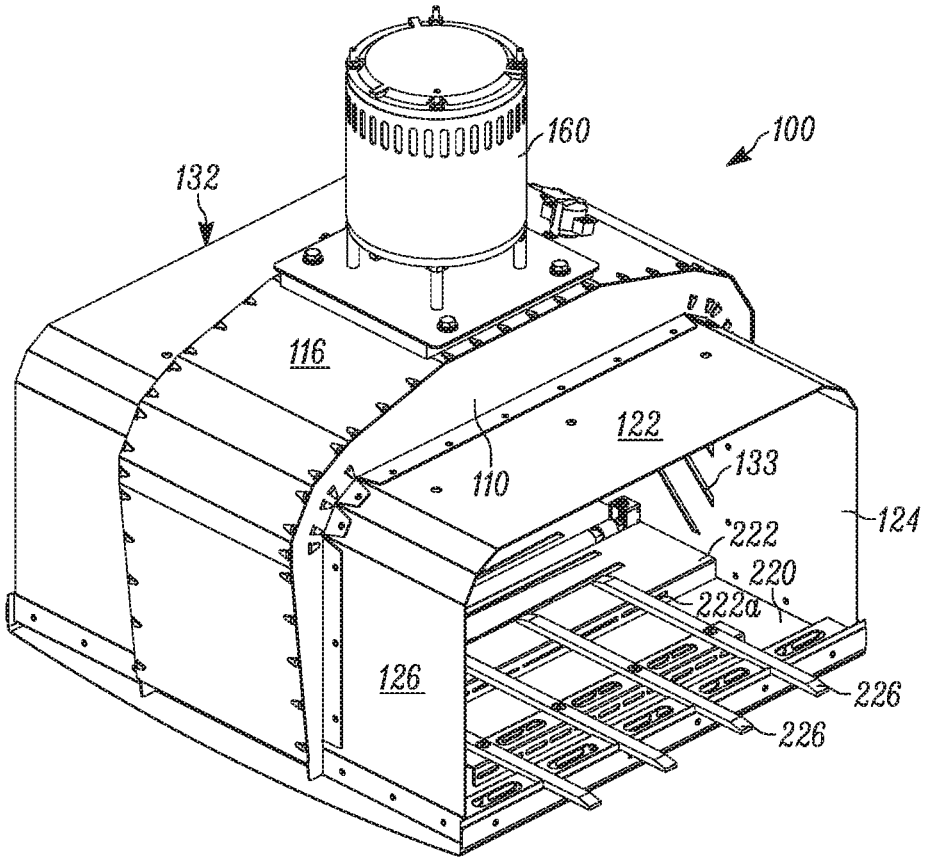

FIGS. 5A-5B illustrate a heating duct assembly 100 which forms part of the shrink tunnel 30. The duct assembly 100 is operative to circulate heated air onto and around a package carried through the tunnel 30 by the conveyor 30*a* to effect shrinkage of the sealing film around the package. According to the invention, the duct assembly 100 is made using a methodology that allows an assembly person to construct the duct assembly without the need for sophisticated and expensive tooling. The methodology to be described is especially useful for making complex metal shapes for housings and the like for low volume products which cannot justify the expense of stamping dies, etc.

The duct assembly 100 is fabricated from individual sheet metal pieces. In particular, it includes a pair of horseshoe-shaped side panels 110, 112 to which an upper duct panel 116 is attached. The horseshoe-shaped side panels 110, 112 are also attached to a U-shaped tunnel member 120 having a top panel 122 and two side panels 124, 126. A hot air duct, which directs hot air from an inlet opening 130 to outlets 132 defined by the U-shaped tunnel member 120. The heated air is conducted from the inlet 130 to the outlets 133 by a duct that is defined by the upper duct panel member 116, the inside surfaces of the horseshoe members 110, 112 and a portion of the tunnel member panels 122, 124, 126.

As seen best in FIG. 5B, the shrink tunnel also includes a base or bottom panel 220 which is suitably joined to the bottom ends of the U-shaped tunnel member 132. Mounted to the bottom panel is a duct 222 having openings 222*a* through which heated air flows. Mounted to the bottom panel are slide blocks 226 which slidably support the underside of the conveyor belt 80 (shown in FIG. 4A). The U-shaped tunnel member 132, in cooperation with the bottom panel 220, defines a heated chamber through which packages to be sealed are conveyed by the conveyor 80.

Figure 6A:
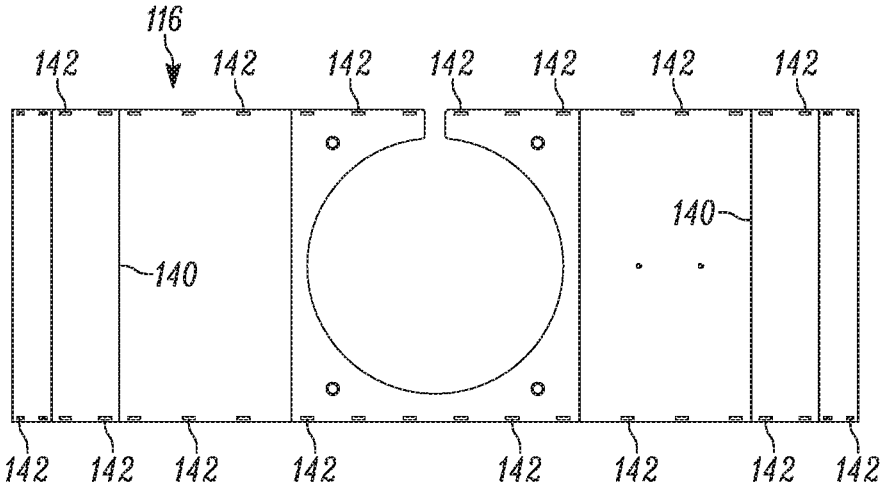
FIG. 6A is an enlarged fragmentary view of the heating duct panel shown in FIG. 6.
Figure 6B:
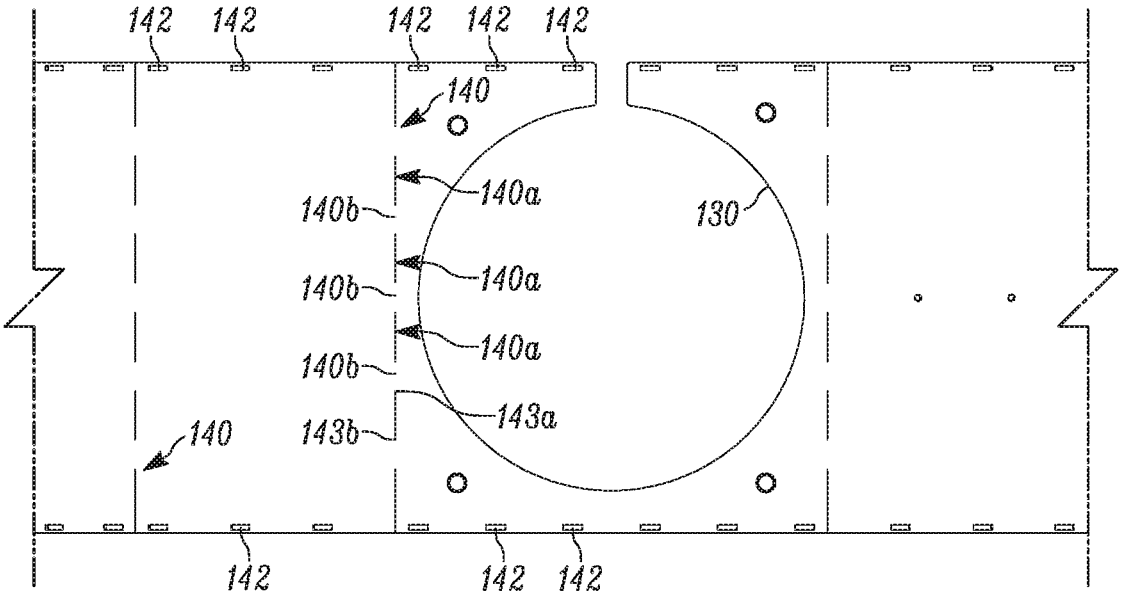
FIG. 6 is a plan view of a heating duct panel constructed in accordance with a preferred embodiment of the invention.
Figure 7:
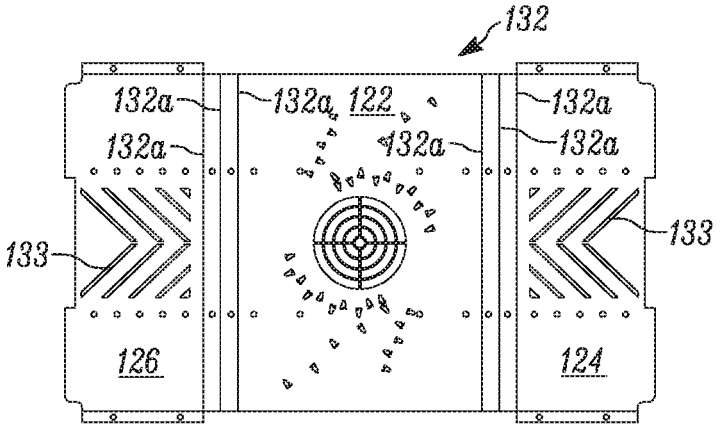
FIG. 7 is a elevational view of a tunnel member prior to a forming step.
Figure 8:
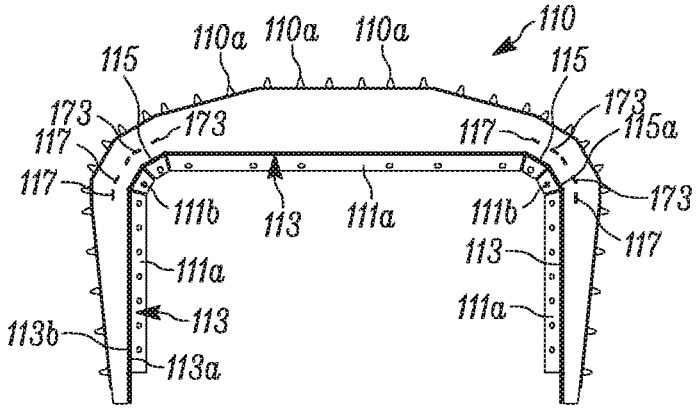
FIG. 8 is a elevational view of a side plate forming part of the heating duct assembly shown in FIG. 5.
Figure 9:
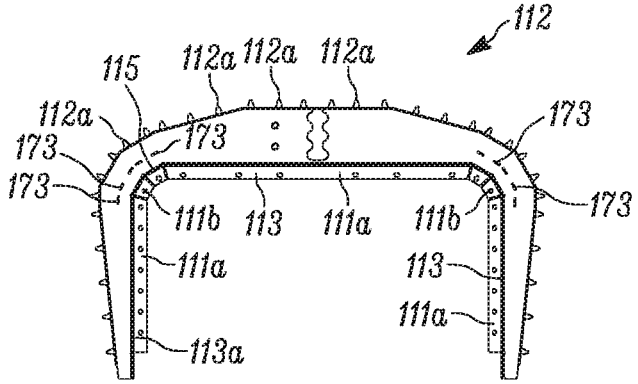
FIG. 9 is an elevational view of another side plate forming part of the duct assembly shown in FIG. 5.

FIGS. 6-10 illustrate individual parts of the duct assembly 100 before they are formed into their final shapes. FIG. 6 illustrates the upper duct panel 116. According to the invention, the upper duct panel 116 includes a plurality of lines of weakness 140, as well as a plurality of slot-like openings 142 for receiving tabs 110*a*, 112*a*, that are formed on the horseshoe-shaped side panels that are shown in FIGS. 8 and 9. According to the invention, the lines of weakness 140 are preferably formed on a laser cutter (see FIG. 6A). Each line of weakness 140 comprises a series of slots 140*a* that are located between bridging sections 140*b*. The panel is easily bent along a line of weakness 140 by an assembly person without the need for sophisticated bending tools.

Referring in particular to FIG. 6A, according to the invention, when a panel is bent along a line of weakness such as 140, opposite edges 143*a*, 143*b* of the slot 140*a* contact each other and substantially create a seal tending to inhibit air leakage through the slot. Depending on the extent of bending, the bridging segments 140*b* both stretch to accommodate the bend as the opposite edges 143*a*, 143*b* engage each other and possibly deform in order to accommodate the movement of the panel segments on either side of the line of weakness 140.

As indicated above, the panel 116 forms one wall of a heating duct for directing heated air from the unit 130 to the outlets 133. It should be noted here that the heated air, as is known, is generated by a motor powered fan 160 and a heating element mounted in or adjacent the inlet 130. It has been found with the disclosed construction that uses lines of weakness to define bending locations for the panel, that a substantially air tight duct is created. It has been found that when a panel is bent along a line of weakness, opposite edges of the slots 140*a* (see FIG. 6A) engage or abut each other as the panel is bent, creating a relatively air tight interface. Depending on the extent of the bend, the bridging segments 140*b* may stretch slightly to accommodate the engagement of the slot edges. In other words, for relatively sharp angled bends, the bridging segments 140*b* will stretch in order to accommodate the bend.

Referring in particular to FIGS. 8 and 9, further details of the horseshoe-shaped side panels 110, 112 are illustrated. In addition to the tabs 110*a*, a series of straight flanges 111*a* and angled flanges 111*b* are integrally formed in the side plate. These flanges also include associated lines of weakness indicated generally by the reference characters 113, 115 and like the lines of weakness 140, include cuts 113*a*, 115*a* between bridging segments 113*b*, 115*b*. These lines of weakness enable the flanges to be easily bent into the 90° configuration that is needed to attach the side plates 110, 112 to the tunnel panel 132. The side plates 110, 112 also include a plurality of slots 117, 173 which receive tabs formed on spacing members or segments 170, to be described.

Figure 10A:
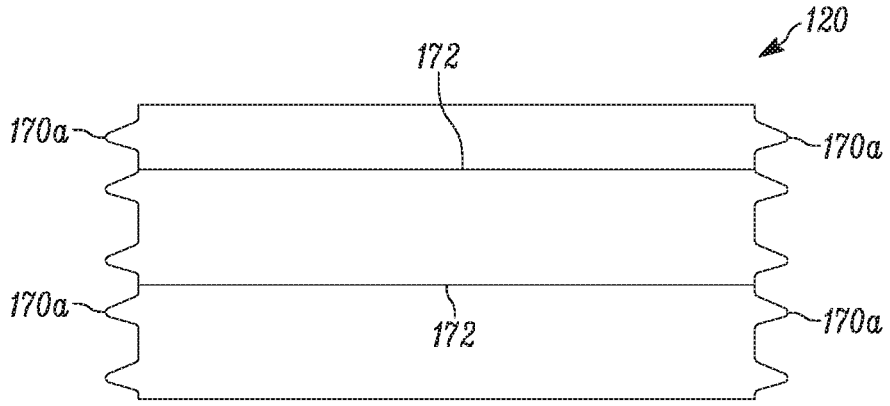
FIG. 10A is an elevational view of a spacing/strut member forming part of the heat duct assembly.
Figure 10B:
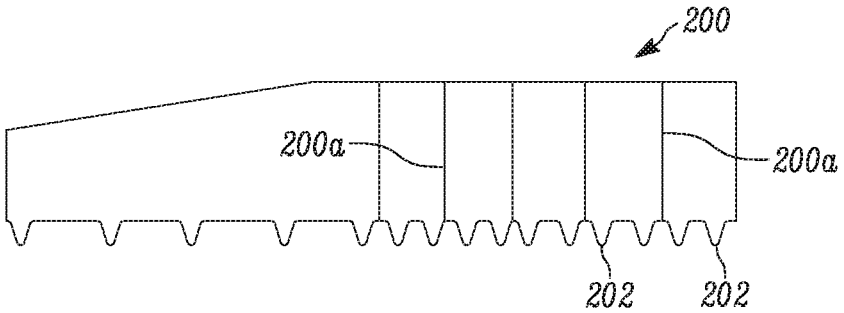
FIG. 10B is an elevational view of a scroll member forming part of the heating duct assembly.
Figure 10C:
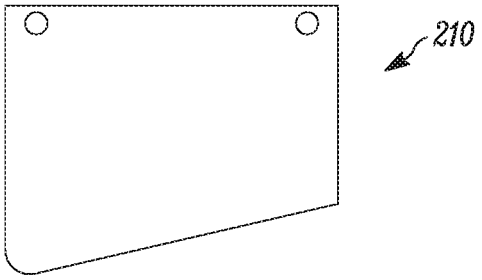
FIG. 10C is elevational view of a diverter panel forming part of the duct assembly shown in FIG. 5.

FIG. 11 labeled "assembly step 1" illustrates the initial assembly steps that are used to make the duct assembly 100. The side panels 110, 112 are joined together by joining segments 170 as seen in FIG. 11*a*. Referring also to FIG. 10A, the segments 120 include lines of weakness 172 which allow the joining segments 120 to be easily bent (along the lines of weakness) so that tabs 170*a* can be inserted into appropriate openings in each side panel 110, 112. Preferably, the tabs 170*a* are bent over using a hammer or other suitable tool to secure the joining segments to the side panels 110, 112 via slots 117, 173 (shown best in FIG. 11B).

Turning next to FIG. 12, which illustrates "assembly step 2", the upper duct panel 116 shown in FIG. 6 is then positioned over the top edges of the side panels 110, 112. In so doing, tabs 110*a*, 112*a* formed on the side panels 110, 112 pass through slots 142 formed in the upper panel 116 and the upper panel is bent along the lines of weakness 140 in order to cause the upper panel 116 to conform to the shape of the horseshoe-shoe shaped side panels 110, 112. This is shown in FIG. 12*a*. After the upper panel is bent into position, the tabs 110*a*, 112*a* in the horseshoe-shaped side panels 110, 112, which now extend through the slotted openings 142 in the upper panel 116, are bent over to lock the panel 116 to the horseshoe-shaped side panels 110, 112.

Figures 14, 14A, 14B, 14C, 14D, 14E, 14F:
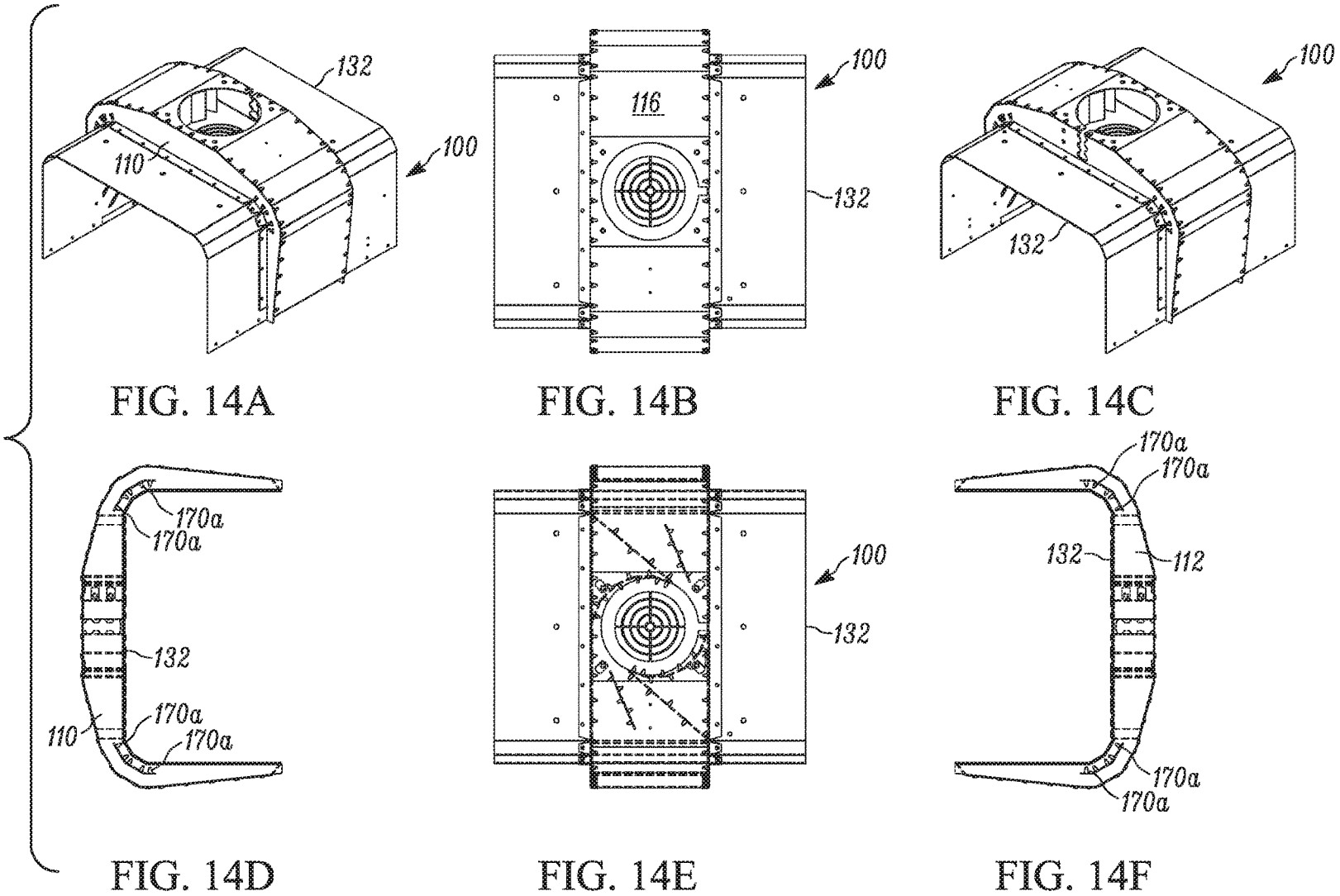
FIG. 14 illustrates the final assembly step for the heating duct assembly shown in FIG. 5.

The tunnel member 132 is bent along its associated lines of weakness 132*a* to form a U-shaped member. FIG. 7 illustrates the tunnel member 132 before it is bent. The subassembly that comprises the upper duct panel 116 and the horseshoe-shaped side panels 110, 112 is then coupled to the tunnel member 132, as illustrated in Assembly Step 4 (see FIG. 14). Prior to mounting the upper duct subassembly to the tunnel member 132, scrolls 200 which also include lines of weakness 200*a* are bent into shape and include tabs/tongues 202 that are inserted into associated slots in the upper panel segment 122 of the tunnel member 132. Diverter plates 210 are also suitably secured to the upper tunnel panel 122 (as by rivets). FIG. 14 (Assembly Step 4) illustrates the mounting of the upper duct subassembly to the tunnel member 132. Again, tabs or flanges, are used to secure the upper duct subassembly to the tunnel member. In general, flanges are defined by lines of weakness and suitably are attached to associated panels as by rivets.

It should be obvious from the above, that the entire duct assembly can be constructed by an assemblyman, without the need for special tools and without the need for expensive stamping dyes. The lines of weakness created by laser cutting operation allow the panels to be easily bent into proper shape by the assemblymen, so that the entire heating duct assembly can be assembled on a bench without the need for any special tools or automated equipment.

In the illustrated embodiment, the various panels and side plates are formed from aluminum plated or aluminum steel sheet metal so that the panels can be easily bent along the created lines of weakness. In the preferred embodiment, the lines of weakness are created by a laser cutter, but other methods for creating these lines of weakness are contemplated such as a water jet-type cutter, etc.

It should be noted that the width of the slots 140*a* and the width of the bridging segments 140*b* may vary depending on the material chosen for the sheet metal panel and the thickness of that panel. For the illustrated duct assembly 100, it has been found that sheet metal having a thickness of 0.60 in (16 gauge) and lines of weakness formed by slots having a width of approximately 0.003-0.004 inches that are separated by bridging segments 140*b* having a width of approximately 0.70 inches provide satisfactory results. The length of the slots 140*a* may vary depending on the material, material thickness, etc. The slots 140*a* and bridging segments are selected to provide panel sections that can be bent along the lines of weakness using hand tools.

Figure 15A:
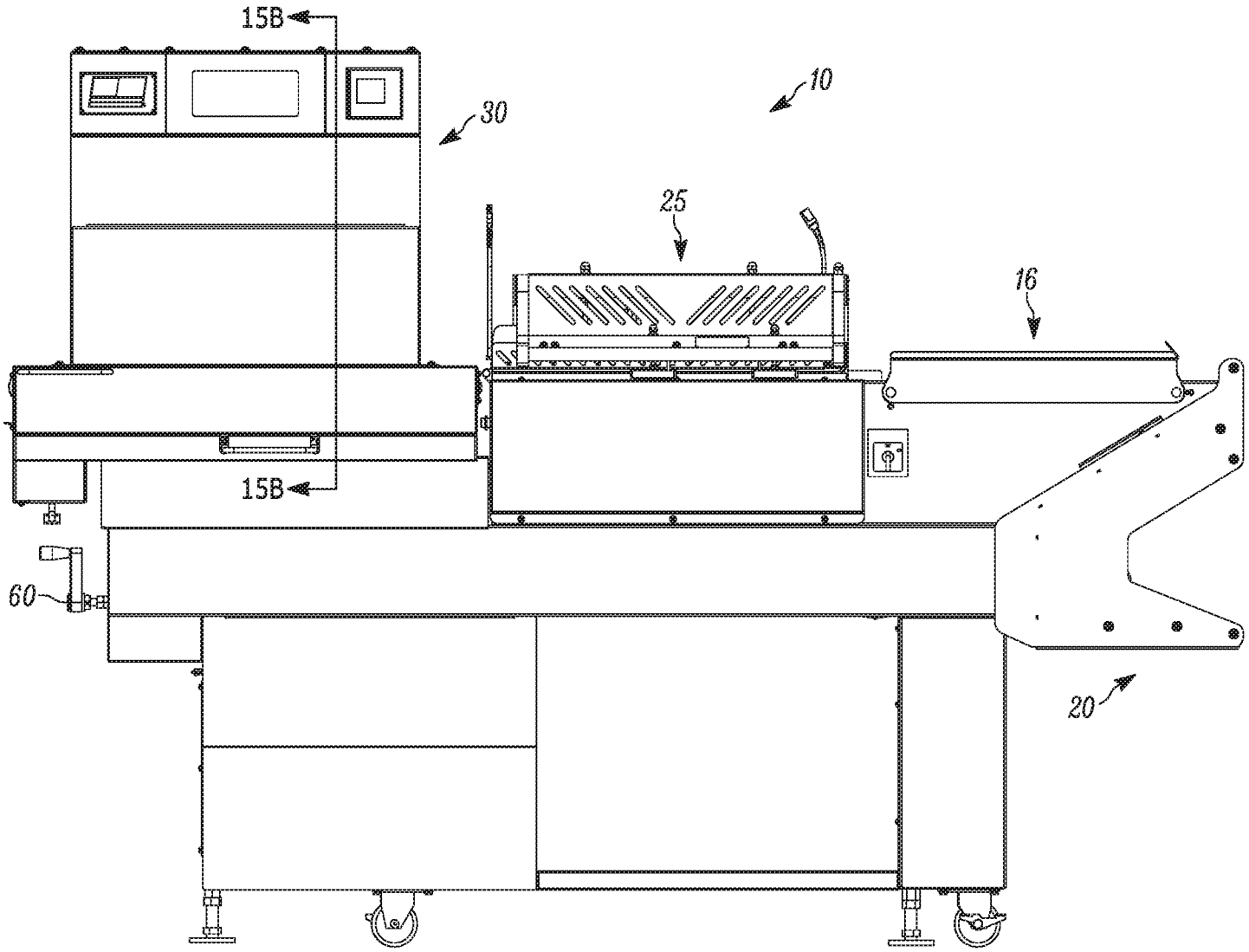
FIG. 15A is a side elevational view of the packaging machine shown in FIG. 1A.
Figure 15C:
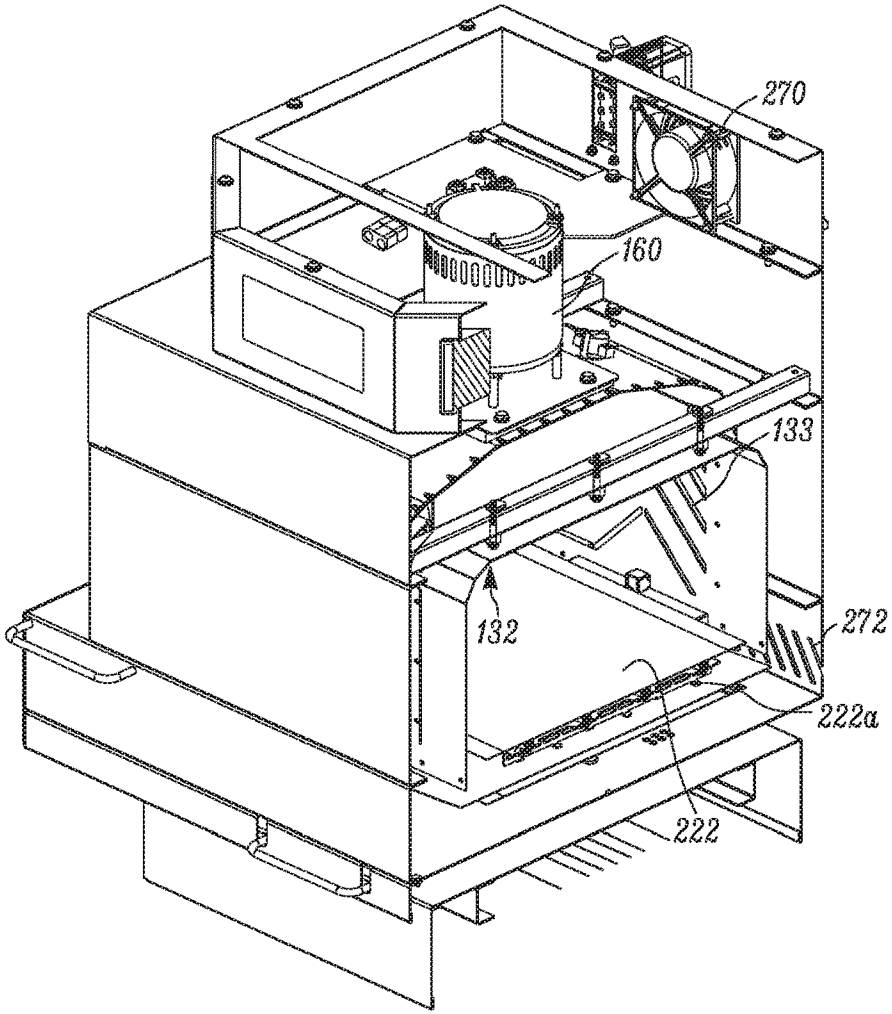
FIG. 15C is a isometric, fragmentary sectional view of the shrink tunnel forming part of the present invention.
Figure 15B:
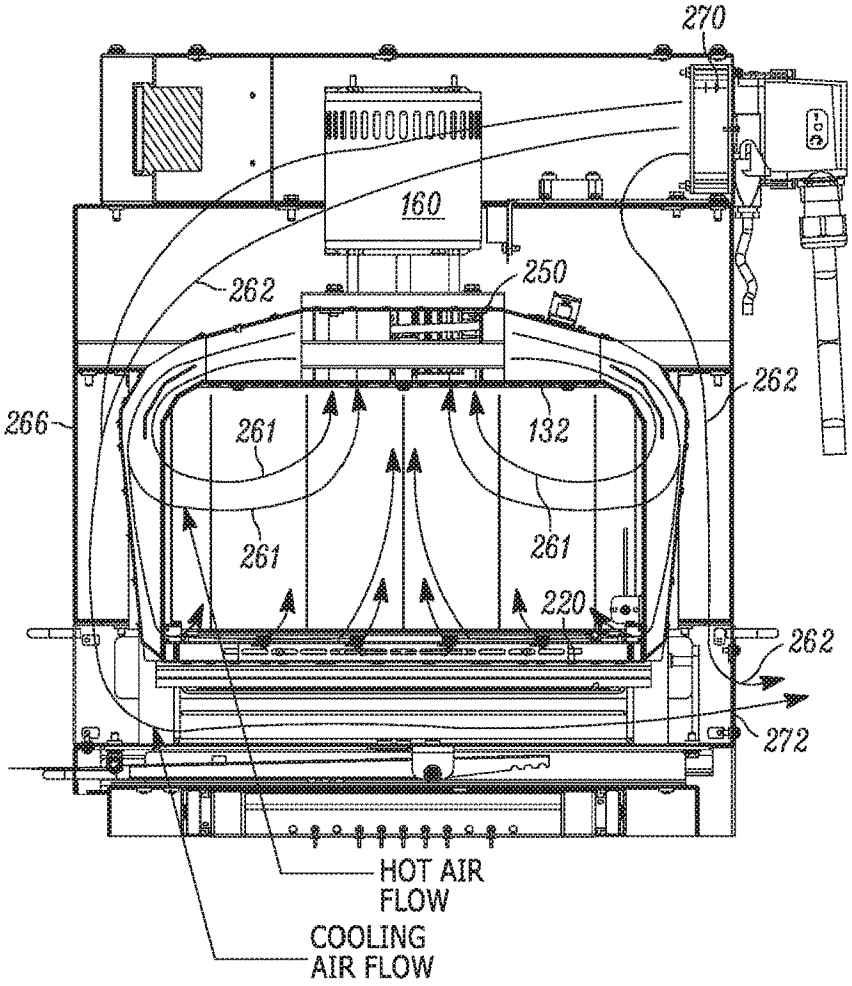
FIG. 15B is a fragmentary, sectional view as seen from the plane indicated by the line A-A in FIG. 15A.

Referring to FIGS. 15A-15C, the disclosed heat sealing packaging machine includes a cooling feature which inhibits the heat from the sealing tunnel to be transmitted to exterior surfaces of the machine. Referring, in particular, to FIG. 15B, the flow of heated air and the flow of cooling air is illustrated. As explained earlier, heated air for shrinking packaging material as the package travels through the tunnel, is provided by a fan 160 mounted to the top of the U-shaped, heating air duct. The air is heated by a heating element 250 and is injected into the chamber defined by the U-shaped tunnel member 132 and base member 220. As explained earlier, hot air is injected into the chamber via ports 133 and lower duct 222 that is mounted to the base plate 220. The flow path of heated air is indicated by the arrows 261. Referring also to FIG. 15C, cooling air indicated by the flow lines 262, flows past the exterior of the shrink tunnel to inhibit heat from the shrink tunnel to flow directly to an outside surface, i.e., surface 266 of the packaging machine. This cooling air flow is generated by a cooling fan 270 (shown best in FIG. 15C) and flows around the outside of the shrink tunnel member 132 and is exhausted through a port or discharge opening 272. With the disclosed invention, external surfaces of the heat sealing packaging machine, are maintained at a comfortable temperature.

The invention has been described in connection with the making/building of a heat shrink packaging machine that includes a heat shrink tunnel. The disclosed methodology for making the hot air duct assembly should not be limited to this application. This methodology can be applied to other components that are fabricated from sheet metal that needs to be joined or bent and it is desired to have the joining and bending of these components to be accomplished without expensive tooling or stamping dies. The disclosed methodology allows rather complex sheet metal parts to be fabricated and assembled by an assemblyman with commonly available hand tools. The methodology can be applied to materials other than aluminum-plated steel and, in general, can be used in connection with various flat-rolled ductile materials that need to be formed and/or joined.

Appendix 2, containing FIGS. A-1 through A-13 illustrates additional details of the invention and is hereby incorporated by reference.

The invention claimed is:

1. A heat sealing packaging machine, comprising:

a) a package platform for supporting a package to be packaged;

b) a film carriage carrying a supply of film material;

c) a sealing platform adjacent said package platform and including a conveyor for laterally moving a package to be sealed from said sealing platform to a heated shrink tunnel;

d) said carriage laterally movable to adjust the position of said supply of film material;

e) a lifting mechanism that raises and lowers said sealing platform and said heated shrink tunnel;

f) said shrink tunnel being laterally movable with respect to said sealing platform and including a latch mechanism that locks a lateral position of said shrink tunnel with respect to said sealing platform.

2. The heat sealing packaging machine of claim 1 wherein said heated shrink tunnel includes a heated air duct assembly, said duct assembly including at least one panel having a plurality of lines of weakness for facilitating bending of said panel into a predetermined configuration by an assembly person, said lines of weakness comprising at least one transverse slot intermediate bridging segments, said slot defining the location of a bend and said slot configured such that, upon bending along said line of weakness, opposite edges of said slot co-engage to inhibit the passage of heated air through said slot.

3. The heat sealing packaging machine of claim 2 wherein said duct assembly includes components having flanges that are also bent along lines of weakness and are adapted to attach to other duct components using fasteners.

4. The heat sealing packaging machine of claim 3 wherein said panel includes a plurality of slots adapted to receive tabs formed on side plates, said tabs being bendable by an assembly person after passing through said slots to thereby attach said panel to said other plate member.

5. The heat sealing packaging machine of claim 1 wherein said latch mechanism is engageable with one or more of a plurality of slots forming part of said film carriage and whereby said film carriage is locked in a position relative to said package platform.

6. The heat sealing packaging machine of claim 1 wherein said lifting mechanism is a zero gravity, scissors-type.

7. The heat sealing packaging machine of claim 1 wherein said latch mechanism is handle operated and includes a toothed track engageable by said handle operated latch mechanism.

8. The heat sealing packaging machine of claim 1 further including a chamber surrounding said shrink tunnel through which outside air is circulated in order to inhibit the transmission of heat from the shrink tunnel to outside surfaces of said packaging machine.

9. The heat sealing packaging machine of claim 2 wherein said heated air duct assembly is U-shaped and receives heated air from a centrally located port and injects heated air into a chamber enclosed by a U-shaped member forming part of said shrink tunnel.

10. A heat sealing packaging machine, comprising:

a) a package platform for supporting a package to be packaged;

b) a film carriage carrying a supply of film material, said film carriage including a tension roller for maintaining tension on film material discharged by said supply;

c) a sealing platform adjacent said package platform and including a conveyor for laterally moving a package to be sealed from said sealing platform to a heated shrink tunnel;

d) said carriage laterally movable to adjust the position of said supply of film material, said carriage including a locking lever engageable with one of a plurality of openings whereby said carriage is locked in a selected lateral position;

e) a lifting mechanism that raises and lowers said sealing platform and said heated shrink tunnel;

f) said shrink tunnel being laterally movable with respect to said sealing platform and including a latch mechanism that locks a lateral position of said shrink tunnel with respect to said sealing platform, said shrink tunnel movably held by track ways which allow relative lateral movement between said shrink tunnel and a frame member and said latch mechanism includes a toothed track engageable by a toothed latch plate operatively connected to an operating handle.

11. The heat sealing packaging machine of claim 10 wherein said shrink tunnel includes a U-shaped member and base member which define a heated chamber through which packages to be sealed, travel.

12. The heat sealing packaging machine of claim 10 wherein said packaging machine includes exterior panels spaced from said shrink tunnel to define passages for allowing cooling air to flow past an outside surface of said shrink tunnel to inhibit the transmission of heat from said shrink tunnel to exterior panels of said packaging machine.

13. The heat sealing packaging machine of claim 12 wherein said cooling air from said passages is provided by a cooling fan that forces air received at an inlet to flow around said shrink tunnel and out discharge port.

14. The heat sealing packaging machine of claim 10 wherein said lifting mechanism is a zero gravity, scissors-type.

15. The heat sealing packaging machine of claim 10 wherein said latch mechanism is handle operated and includes a toothed track engageable by said handle operated latch mechanism.

* * * * *